US012070675B2

(12) United States Patent
Adeniran

(10) Patent No.: US 12,070,675 B2
(45) Date of Patent: Aug. 27, 2024

(54) EXERCISE GLOVE

(71) Applicant: Tokunbo Oluwaseun Adeniran, Katy, TX (US)

(72) Inventor: Tokunbo Oluwaseun Adeniran, Katy, TX (US)

( * ) Notice: Subject to any disclaimer, the term of this patent is extended or adjusted under 35 U.S.C. 154(b) by 44 days.

(21) Appl. No.: 17/489,052

(22) Filed: Sep. 29, 2021

(65) Prior Publication Data

US 2022/0134213 A1 May 5, 2022

Related U.S. Application Data

(60) Provisional application No. 63/106,943, filed on Oct. 29, 2020.

(51) Int. Cl.

| | |
|---|---|
| ***A63B 71/14*** | (2006.01) |
| ***A41D 19/015*** | (2006.01) |
| ***A41D 31/28*** | (2019.01) |
| ***A63B 21/00*** | (2006.01) |
| ***A63B 23/035*** | (2006.01) |
| *A63B 21/065* | (2006.01) |

(52) U.S. Cl.

CPC ..... *A63B 71/145* (2013.01); *A41D 19/01523* (2013.01); *A41D 31/28* (2019.02); *A63B 21/4025* (2015.10); *A63B 23/03508* (2013.01); *A63B 21/065* (2013.01); *A63B 21/4019* (2015.10); *A63B 2244/102* (2013.01)

(58) Field of Classification Search

CPC ..... A63B 21/0602; A63B 71/145; A63B 2244/102; A63B 2244/10

USPC ..... 2/18; 482/88

See application file for complete search history.

(56) References Cited

U.S. PATENT DOCUMENTS 2,284,300 A * 5/1942 De Witt ..... A63B 71/145 2/18
2,740,120 A * 4/1956 Temple ..... A63B 71/145 2/18
4,079,932 A 3/1978 Schuetz (Continued)

FOREIGN PATENT DOCUMENTS

CN 2766910 Y 3/2006
DE 29504195 6/1996

(Continued)

OTHER PUBLICATIONS

The Original Aquabag; Ultimateinstability (retrieved from Internet May 26, 2020).

(Continued)

*Primary Examiner* — Alissa L Hoey
*Assistant Examiner* — Akwokwo Olabisi Redhead
(74) *Attorney, Agent, or Firm* — Hamilton, Brook, Smith & Reynolds, P.C.

(57) ABSTRACT

An exercise device including an outer portion and an inner portion positioned within the outer portion. The inner and outer portions are attached together at a wrist portion in a fluid sealed manner to form a fluid tight cavity between the inner and outer portions. The inner and outer portions are be shaped and sized to provide at least one fluid flow channel or path extending from the wrist portion to a finger portion to allow fluid to flow from the wrist portion to the finger portion and back again, when a user is conducting reciprocating exercises and the fluid cavity is at least partially filled with fluid.

9 Claims, 20 Drawing Sheets

(56) References Cited

U.S. PATENT DOCUMENTS

| | | | | |
|---|---|---|---|---|
| 4,627,613 | A | 12/1986 | Solloway | |
| 5,386,591 | A | 2/1995 | Canan | |
| 5,530,967 | A | 7/1996 | Cielo | |
| 5,575,008 | A | 11/1996 | McBride | |
| 5,704,883 | A | 1/1998 | Eckmann | |
| 6,014,770 | A | 1/2000 | Spector | |
| 6,629,911 | B2 * | 10/2003 | Cook | A63B 21/065 482/124 |
| 6,990,689 | B1 | 1/2006 | Thellmann | |
| 8,727,951 | B2 | 5/2014 | Jones et al. | |
| 11,235,196 | B2 | 2/2022 | Barrow | |
| 2002/0128126 | A1 | 9/2002 | Cook | |
| 2004/0250330 | A1 | 12/2004 | Berman | |
| 2013/0123075 | A1 | 5/2013 | Hmelnitski | |
| 2014/0189925 | A1 * | 7/2014 | Ramirez | A41D 19/0013 2/163 |
| 2014/0215685 | A1 * | 8/2014 | Bush | A63B 71/146 2/161.1 |
| 2016/0051883 | A1 * | 2/2016 | Clement | A63B 71/145 2/161.1 |
| 2021/0170220 | A1 * | 6/2021 | Barrow | A63B 21/4043 |
| 2022/0134213 | A1 * | 5/2022 | Adeniran | A41D 31/28 2/18 |

FOREIGN PATENT DOCUMENTS

| | | | |
|---|---|---|---|
| GB | 2572031 | A | 9/2019 |
| WO | WO 2004/068982 | A1 | 8/2004 |
| WO | WO 2012/140390 | A1 | 10/2012 |

OTHER PUBLICATIONS

HydroCore Bag; Onnit (retrieved from Internet May 26, 2020).
Aqua Training Bag 18 Training Punching Bag—120 lbs.; Walmart.com (retrieved from Internet May 26, 2020).
International Search Report and Written Opinion for PCT/US2021/071639 entitled: Exercise Glove, date of mailing: Jan. 26, 2022.

* cited by examiner

| Part | Material | space | Weight lbs. |
|---|---|---|---|
| inner sleeve | PU | | 0.7174 |
| glove | PU | | 1.5449 |
| inner vol. | water | full | 3.614 |
| inner vol. | water | half | 1.264 |
| | | total full | 5.8763 |
| | | | |
| | | total half full | 3.5263 |

EXERCISE GLOVE

RELATED APPLICATION

This application claims the benefit of U.S. Provisional Application No. 63/106,943, filed on Oct. 29, 2020. The entire teachings of the above application are incorporated herein by reference.

BACKGROUND

Boxers that train punching a heavy bag can experience shoulder and hand injuries due to the high velocity impact.

SUMMARY

The present invention can provide an exercise device that can allow the user to experience an effective resistance workout without hitting a heavy bag. The exercise device can have a wrist or forearm portion and a finger portion. The exercise device can further include an outer portion and an inner portion positioned within the outer portion. The inner and outer portions can be attached together at the wrist portion in a fluid sealed manner to form a fluid tight cavity between the inner and outer portions. The inner and outer portions can be shaped and sized to provide at least one fluid flow channel or path extending from the wrist portion to the finger portion to allow fluid to flow from the wrist portion to the finger portion and back again, when a user is conducting reciprocating exercises and the fluid cavity is at least partially filled with fluid.

In particular embodiments, the outer portion can be an outer mitten portion, the inner portion can be an inner mitten portion, and the exercise device can be an exercise glove. The wrist portion can have an enlarged circumference for containing water and maximizing the volume and length of the at least one fluid channel. The fluid cavity in the wrist portion can have an enlarged gap between the inner and outer mitten portions that extends around at least a majority of the inner mitten portion. The gap in the wrist portion can range from about ¼ inch to about ¾ inches. The gap in selected regions of the finger portion can range from about ½ inch to about 2 inches. Circumferences of the inner and outer mitten portions at the wrist portion can be mostly oval shaped and a cross section of the fluid cavity in the wrist portion can have at least a majority of an oval ring shape. The wrist portion can have a slot extending along a palm side through the inner and outer mitten portions to allow for size adjustments. The fluid cavity at the finger portion can extend around a periphery and a distal end of the inner mitten portion.

The present invention can also provide an exercise device including an outer portion and an inner portion positioned within the outer portion. The inner and outer mitten portions can be attached together at a wrist portion in a sealed manner to form a sealed cavity between the inner and outer portions. The inner and outer portions can be shaped and sized provide at least one flowable material flow channel extending from the wrist portion to a finger portion to allow flowable material to flow from the wrist portion to the finger portion and back again, when the user is conducting reciprocating exercises and the sealed cavity is at least partially filled with flowable material.

In particular embodiments, the inner and outer portions can be attached together in a fluid sealed manner to form a fluid tight cavity. The at least one flowable material flow channel can be at least one fluid flow channel when the fluid cavity is at least partially filled with fluid.

The present invention can also provide a method of exercising with an exercise device, including providing an outer portion and providing an inner portion positioned within the outer portion. The inner and outer portions can be attached together at a wrist portion in a sealed manner to form a sealed cavity between the inner and outer portions. The inner and outer portions can be shaped and sized to provide at least one flowable material flow channel extending from the wrist portion to a finger portion to allow flowable material to flow from the wrist portion to the finger portion and back again. Reciprocating exercises can be conducted with the exercise device while the sealed cavity is at least partially filled with flowable material.

In particular embodiments, the flowable material can be fluid, the sealed cavity can be a fluid tight cavity, the at least one flowable material flow channel can be at least one fluid flow channel, the outer portion can be an outer mitten portion, and the inner portion can be an inner mitten portion, with the exercise device being used as an exercise glove. The volume and length of the at least one flow channel can be maximized by having the wrist portion with an enlarged circumference for containing water. The fluid cavity in the wrist portion can have an enlarged gap between the inner and outer mitten portions that extends around at least a majority of the inner mitten portion. The gap in the wrist portion can range from about ¼ inch to about ¾ inches. The gap in selected regions of the finger portion can range from about ½ inch to about 2 inches. Circumferences of the inner and outer mitten portions at the wrist portion can be mostly oval shaped, and a cross section of the fluid cavity in the wrist portion can have at least a majority of an oval ring shape. The wrist portion can have a slot extending along a palm side through the inner and outer mitten portions. The fluid cavity of the finger portion can extend around a periphery and a distal end of the inner mitten portion.

BRIEF DESCRIPTION OF THE DRAWINGS

The foregoing will be apparent from the following more particular description of example embodiments, as illustrated in the accompanying drawings in which like reference characters refer to the same parts throughout the different views. The drawings are not necessarily to scale, emphasis instead being placed upon illustrating embodiments.

DETAILED DESCRIPTION

Figure 1A:
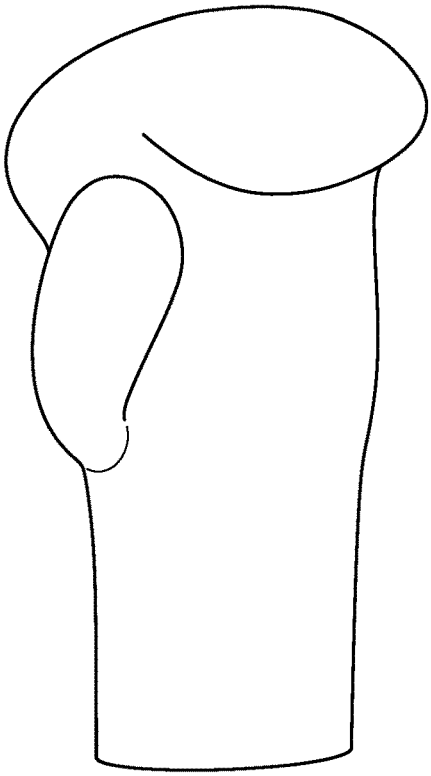
FIGS. 1A-1C are perspective front or palm, back or dorsal, and side views of an embodiment of an exercise device or glove in the present invention.

A description of example embodiments follows.

Embodiments of a low or zero impact aqua exercise device or glove in the present invention can allow anyone anywhere, to throw punches without experiencing impact to the hands, and get an effective resistance workout without hitting the heavy bag.

A Low Durometer rubber can be used to create a hollow version of a traditional boxing glove with a necessary area to insert a hand In lieu of foam padding used in traditional boxing gloves, the insides can be completely hollow. Two separate molds can be fused together to create a glove shape with a valve opening on the dorsal wrist area to allow water, or another liquid, to communicate approximately 100% freely within the glove.

The glove in some embodiments can have a maximum volume allowance of water inside of it up to about 3.7 lbs, not including the 2.2 lbs net weight of the glove itself. This freely communicating water promotes slosh, turbulence and other inertia like effects which creates fitness benefits for the user in the form of various types of resistance (weight/gravity+velocity+resistance to intrinsic self-imposed changes in velocity).

When one embodiment of the glove is filled to its absolute maximum with water or liquids of equal density, the total weight, including the rubber that composes the glove itself, can be approximately 5.9 lbs or more. When this happens, slosh, turbulence and similar inertia created by freely moving liquids are mitigated/reduced. In addition, under the aforementioned circumstances, the glove and its contents tend to act more as a mere dead weight subject to the forces of gravity, itself subjective to the movements of the user which still provides an effective source of resistance for the user for the purpose of exercise or fitness.

An example of usage for the aqua glove; throwing a punch, in a quick, sharp, explosive boxing motion propels the water in the direction of the punch at a high rate of speed. Momentum is then created, but since that same hand needs to return or retract back to its place of origin or another position at a high velocity while that water is still rushing in the direction of the punch, a slosh or turbulent effect is created. This includes but is not limited to boxing. Any natural/unnatural kinetic movement creates a physical benefit for the purpose of increasing physical performance such as speed, explosiveness, endurance, stamina, strength, and including but not limited to amplifying calorie exertion. For example: jumping jacks, shoulder rolls, shoulder press, burpees and many other exercises.

When extending and retracting punches, the aqua glove can provide a proportional effect to holding hand weights, which boxers do to increase strength, speed and endurance, in addition to gravity while enhancing the effectiveness by; conforming and encompassing to the form of the hands which more realistically mimics fatigue during training/fighting, creating an opposing force every time momentum is created by the user which multiplies the resistance the weight has on the body(slosh), and taking away the task of holding a tool which allows the fitness enthusiast or boxer to move naturally and focus which promotes better performance.

The aqua glove can also help prevent or and mitigate shoulder injuries which many boxers face due to the constant jarring to the rotator cuff from hitting near solid objects that resist high velocity impact such as; heavy bags, focus mitts, human skull.

Figure 1B:
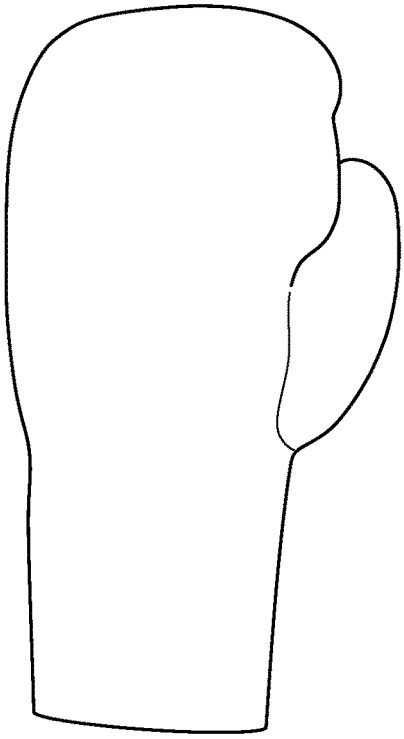
Figure 1C:
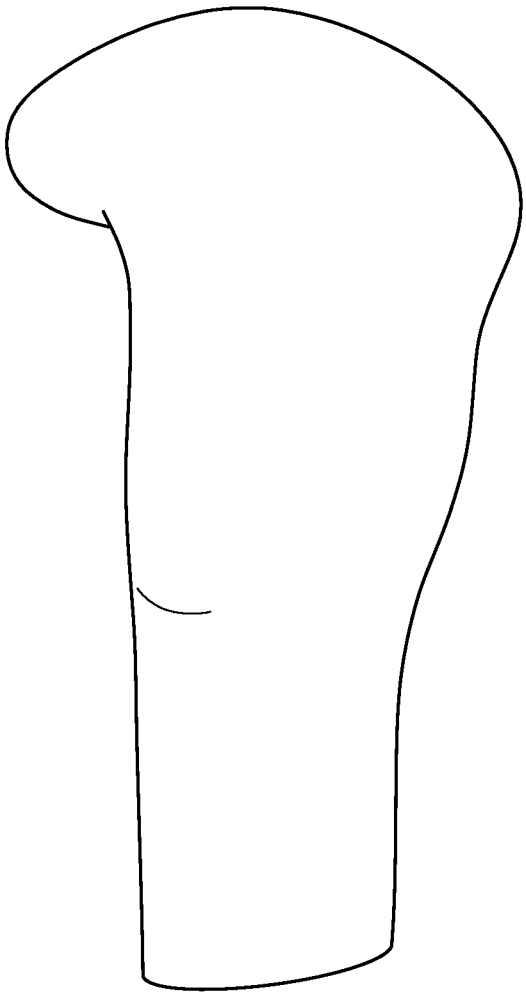
Figure 2A:
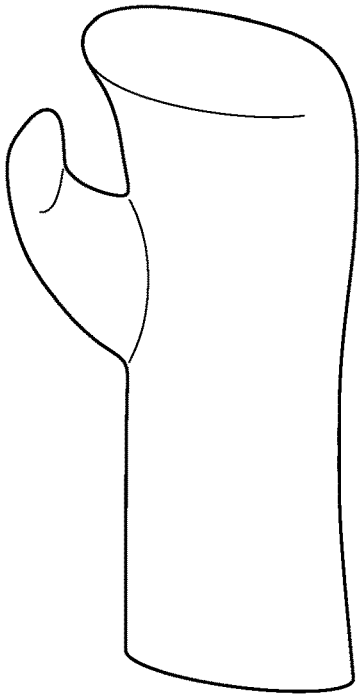
FIGS. 2A and 2B are perspective front of palm, and back or dorsal views of another embodiment of an exercise glove in the present invention.
Figure 2B:
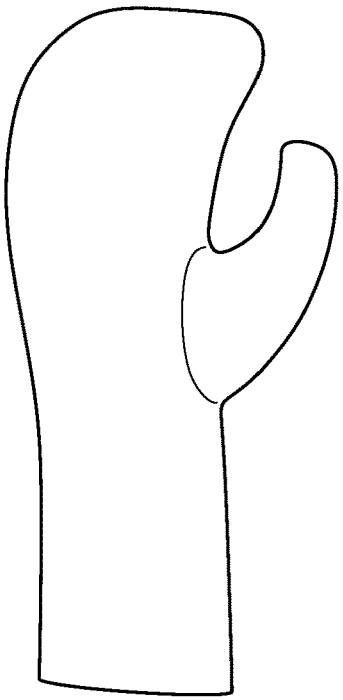

FIGS. 1A-1C depict one embodiment to of an exercise device or glove in the present invention, in which the wall thickness of the rubber can be about 0.125 inches, and FIGS. 2A and 2B depict another embodiment in which the wall thickness can be about 0.1 inches thick.

Figure 3A:
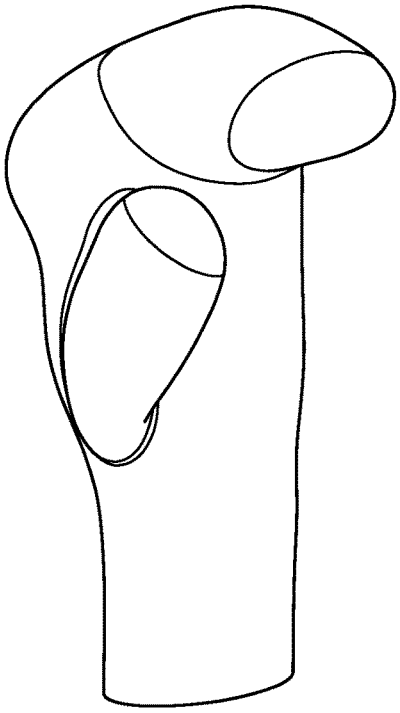
FIGS. 3A-3C are perspective side and sectional views of yet another embodiment of an exercise glove in the present invention.
Figure 3B:
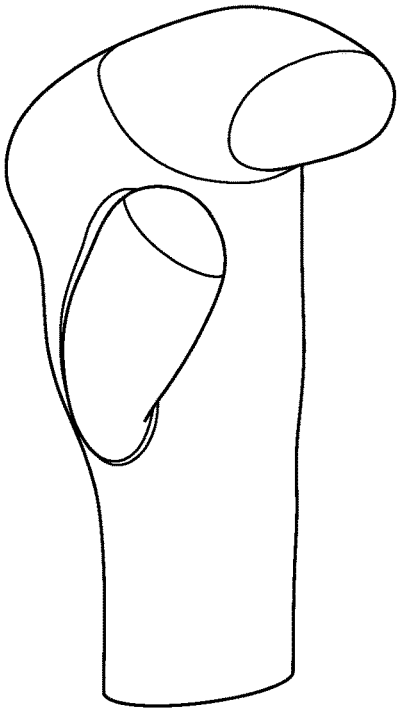
Figure 3C:
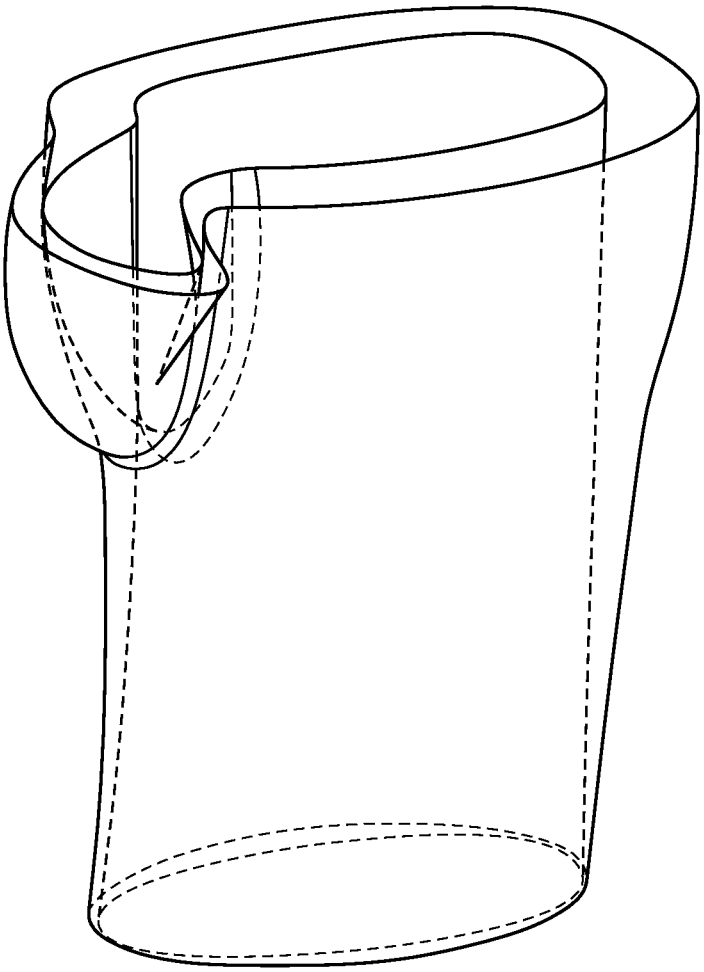

FIGS. 3A-3C depict an embodiment of an exercise device or glove that can hold about 3.61 pounds of water. In FIG. 3C, the space volume is cut approximately in half, and can hold about 1.26 pounds of water.

Figure 4:
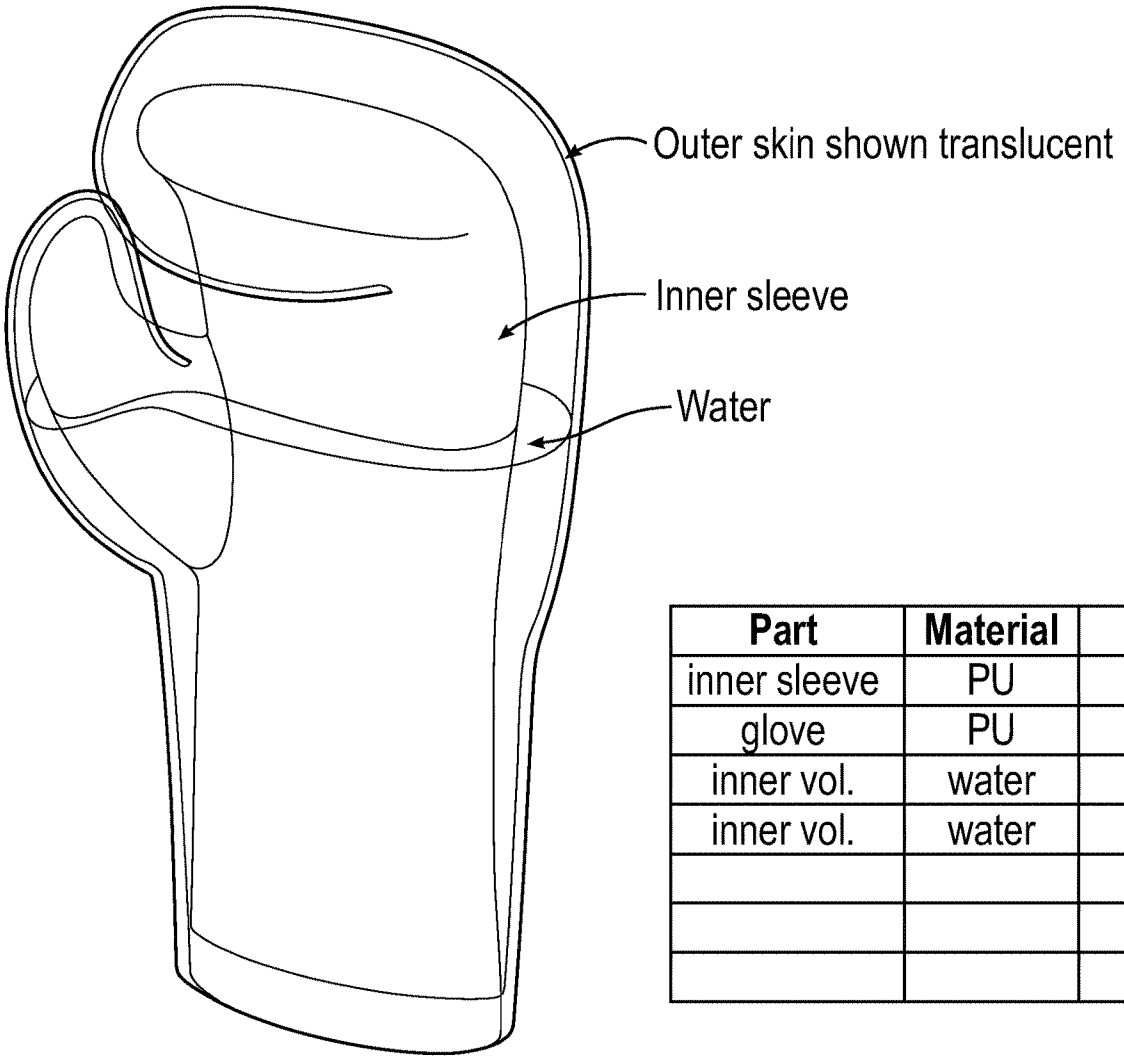
FIG. 4 is a perspective view of still another embodiment of an exercise glove in the present invention.

FIG. 4 depicts an embodiment of an exercise device or glove showing an inner sleeve, glove or mitten portion positioned within an outer skin, glove or mitten portion, with a fluid tight cavity or reservoir therebetween filled with water. The outer skin can be translucent or clear, or portions thereof, and can have graduation markings to indicate the amount of water added and/or weight within the fluid tight cavity.

Figure 5:
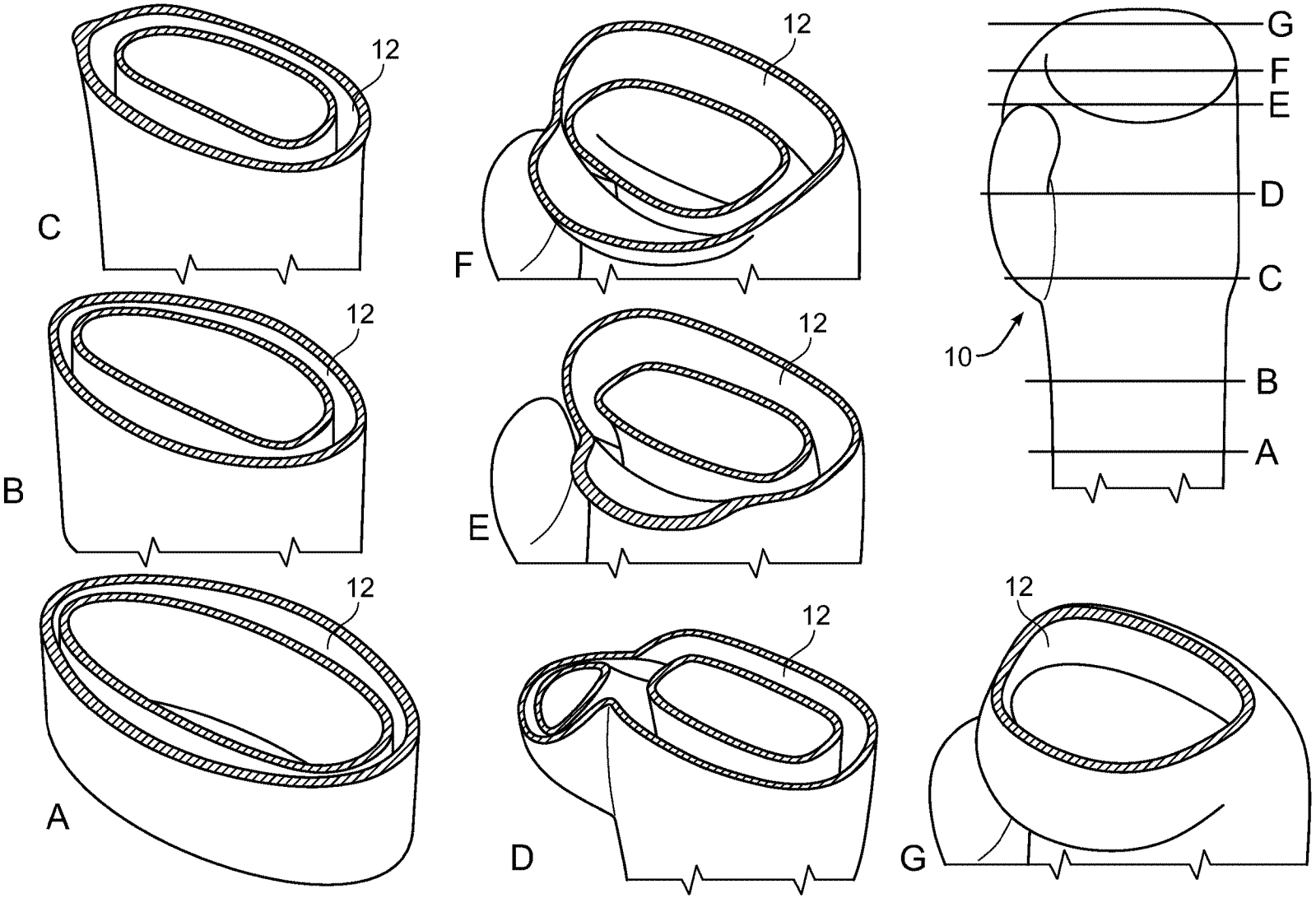
FIG. 5 shows perspective cross-sectional views taken from various locations of an embodiment of the exercise glove in the present invention.

FIG. 5 shows an embodiment of the exercise device or glove 10 with cross-sectional cuts at various glove locations (sections A-G) to show the nature and shape of the fluid tight cavity 12 between the inner and outer mitten portions, which provides at least one fluid flow channel or path extending between the proximal, forearm or wrist end or portion (section A) of the glove, and the distal or finger end or portion of the glove (section G). In some embodiments, standoffs can be positioned between the inner and outer mitten portions at desired locations to provide the at least one fluid flow channel with desired flow characteristics. Different sizes of gloves can be made for different sized hands, such as for children, women or men. Preferably the fluid tight cavity 12 is filled with water, but can be filled with other suitable flowable fluids or materials, for example oil, or gel, or with movable or flowable solids such as metallic balls or particles, for example buckshot or sand. Although preferably formed of rubber, the exercise device or glove can be molded from rigid plastic and does not have to look exactly like a glove or boxing glove. By having a fluid tight cavity 12 that extends around the inner mitten portion circumferentially and around the distal end, at least one fluid flow channel or path is provided between the proximal and distal portions that will allow reciprocating flow of liquid therebetween during reciprocating exercise no matter the orientation of the hand, such as thumb up, palm down, or hand twisting. A fill valve such as a screw in valve can be positioned on the back or dorsal side of the glove and can be flush with the glove surface. Different or lower durometers or thicknesses of rubber can be used to allow better ability to make a fist. The circumference at the forearm or wrist portion (section A) can be made larger to allow more water to be contained at that location, which can allow a further distance for water to travel back and forth in the at least one fluid flow channel during reciprocating exercises.

Figure 6:
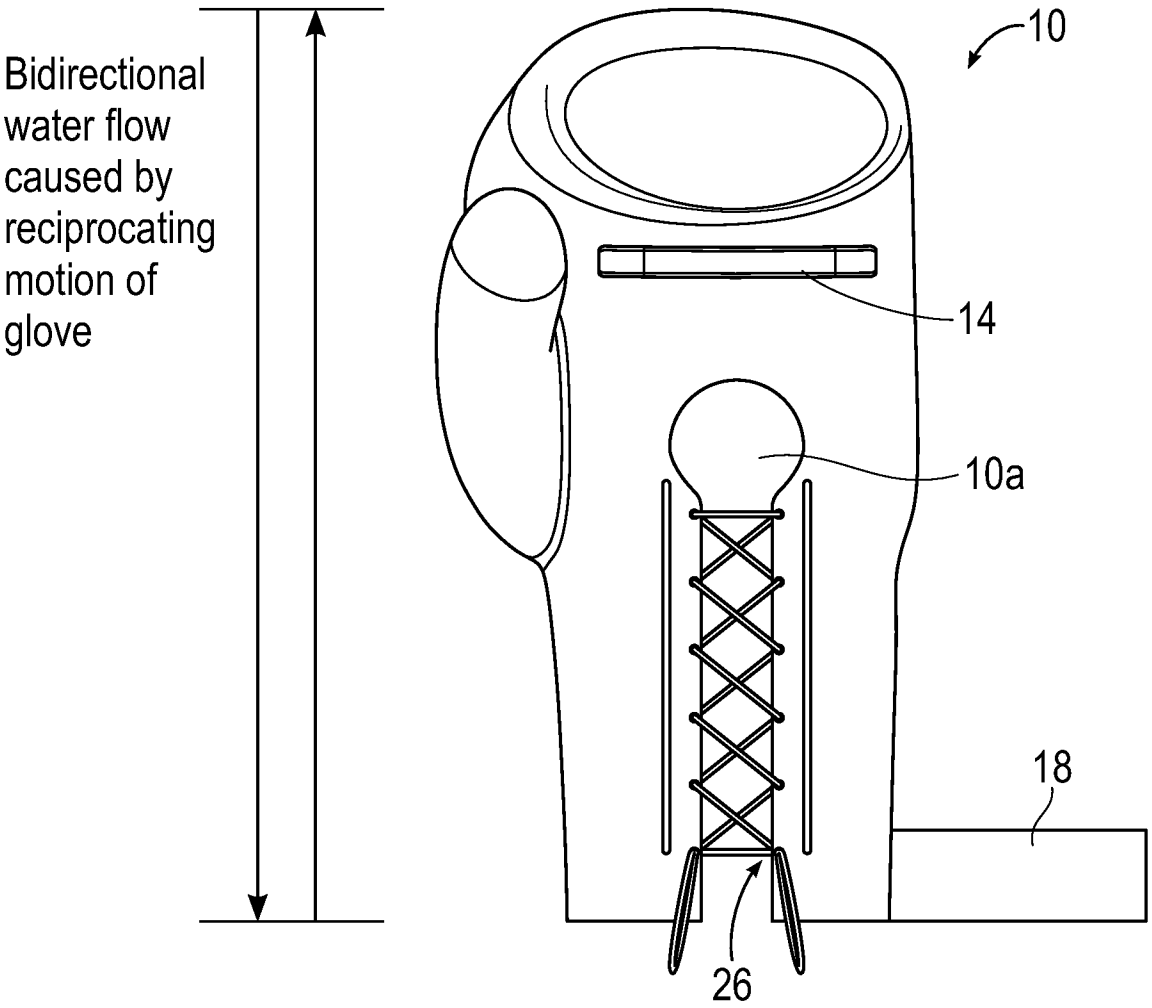
FIG. 6 is a front or palm view of another embodiment of an exercise glove in the present invention.
Figure 7:
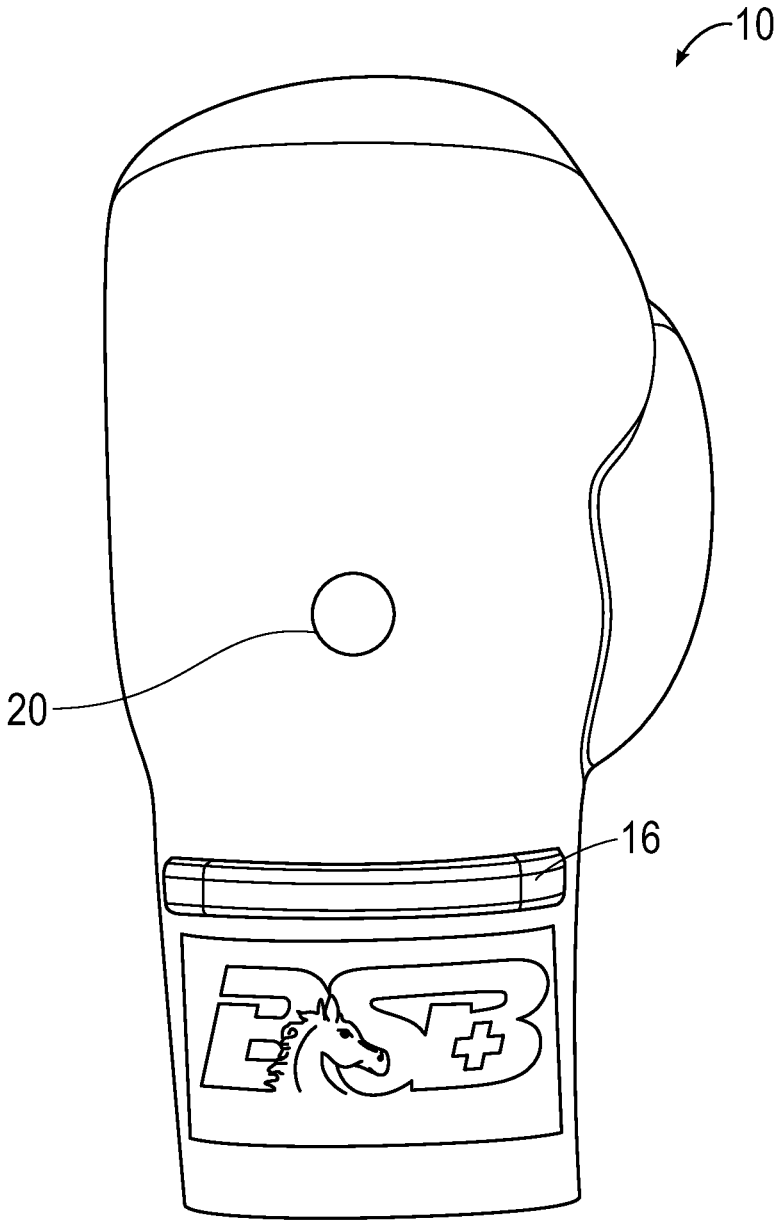
FIG. 7 is a back or dorsal view of the exercise glove FIG. 6.
Figure 8:
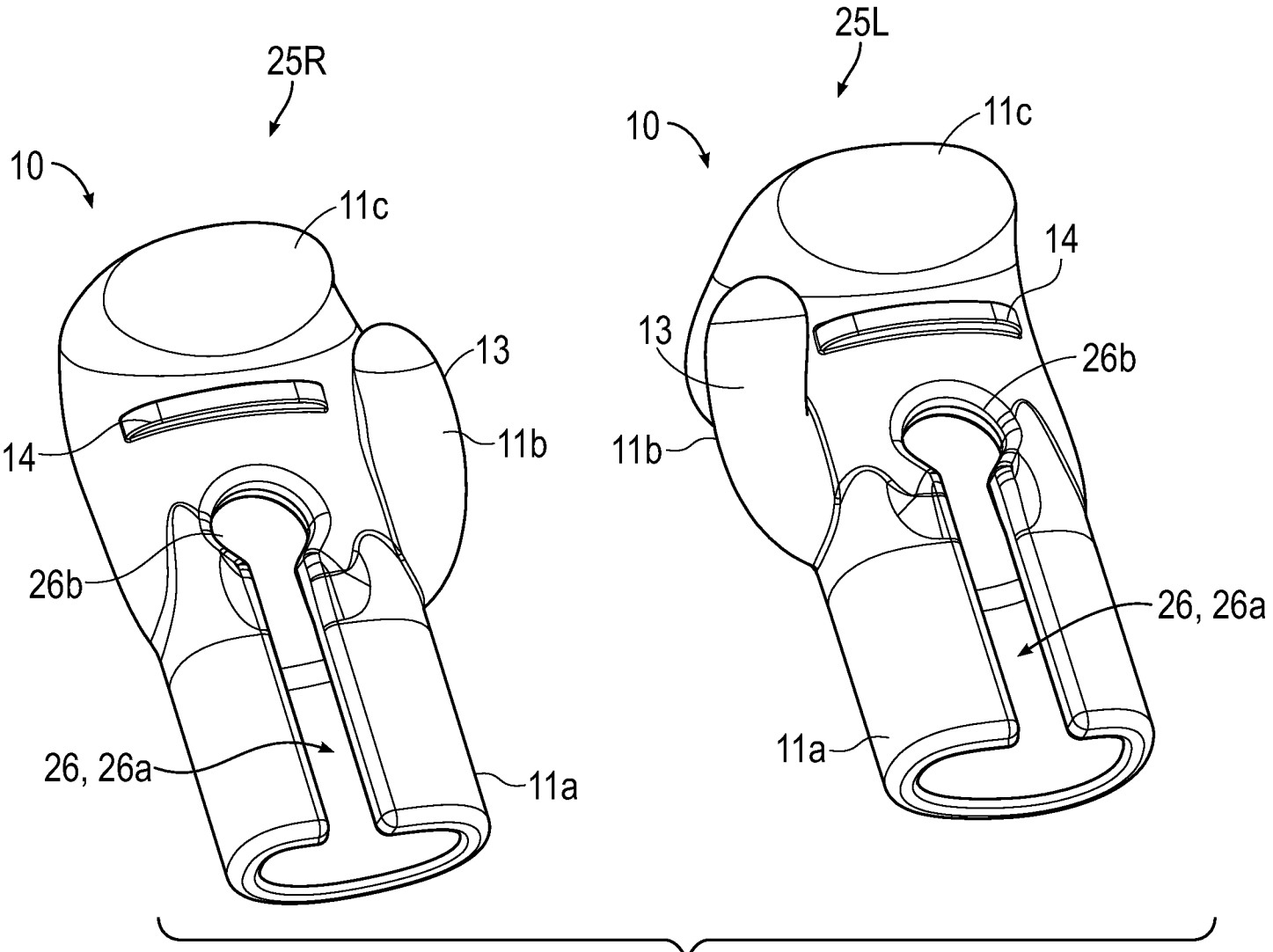
FIG. 8 is a front or palm perspective view of an embodiment of a pair of exercise gloves in the present invention.
Figure 9:
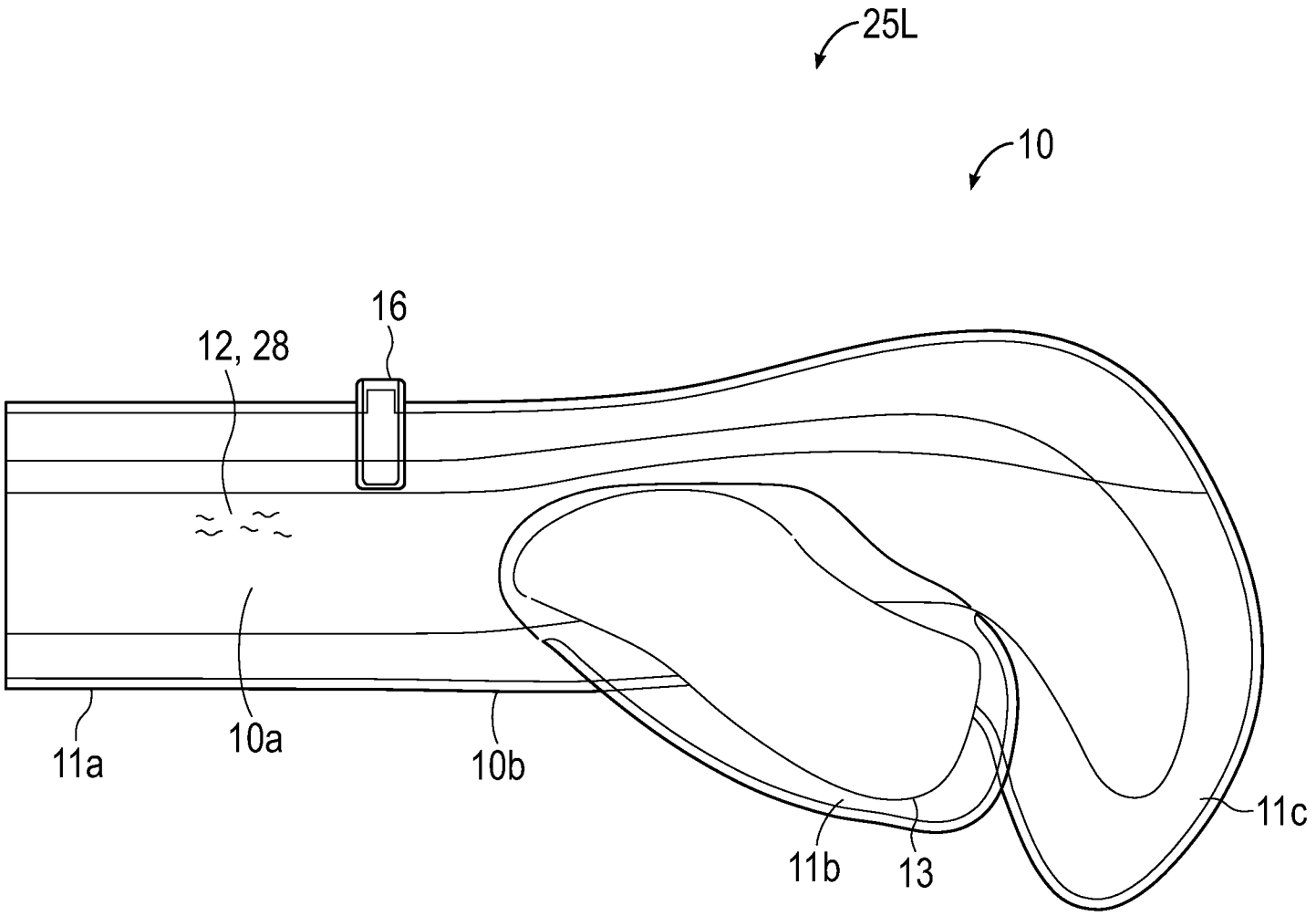
FIG. 9 is a side view of the left glove of FIG. 8 with see through portions.
Figure 10:
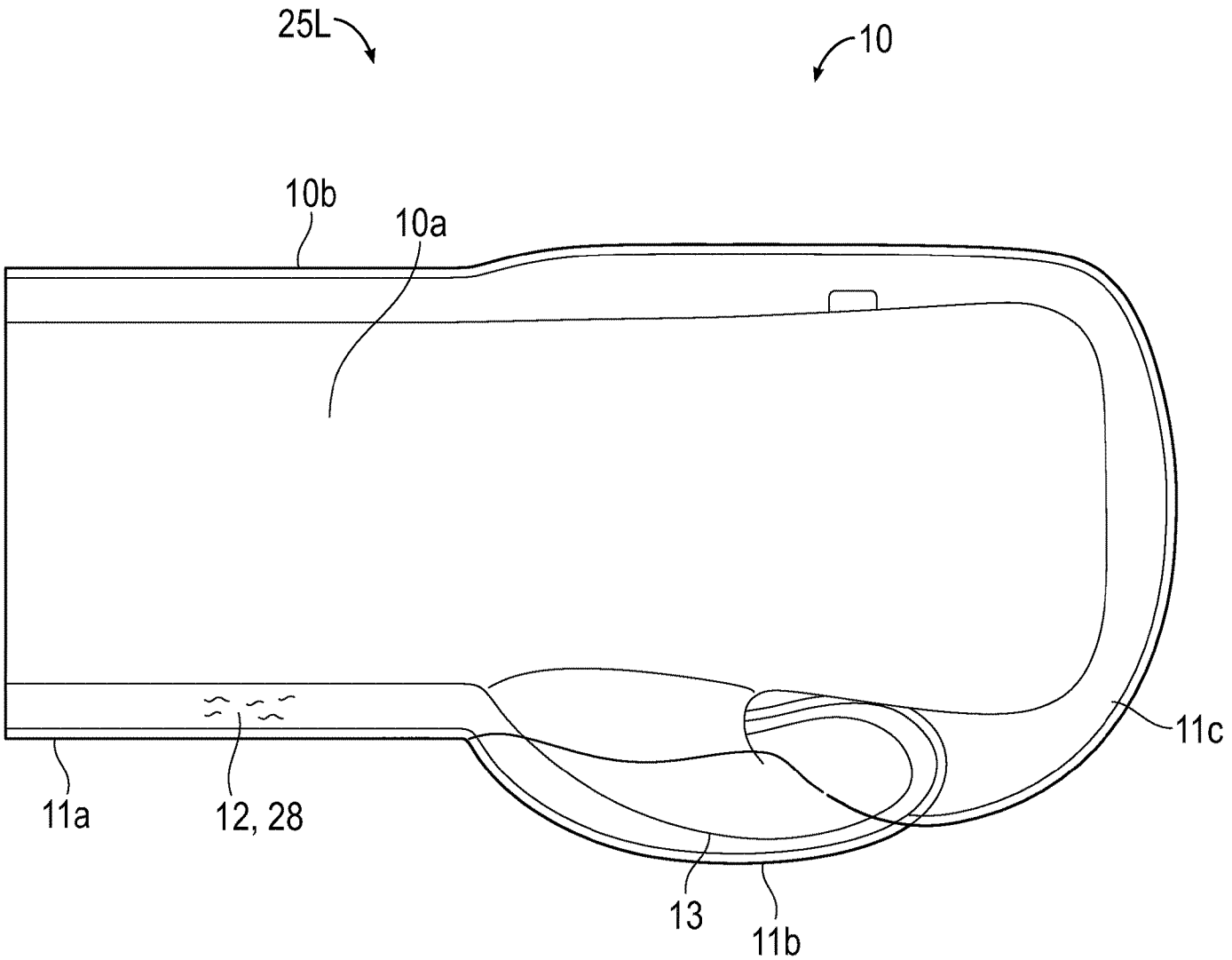
FIG. 10 is a back or dorsal view of the left glove of FIG. 8.
Figure 11:
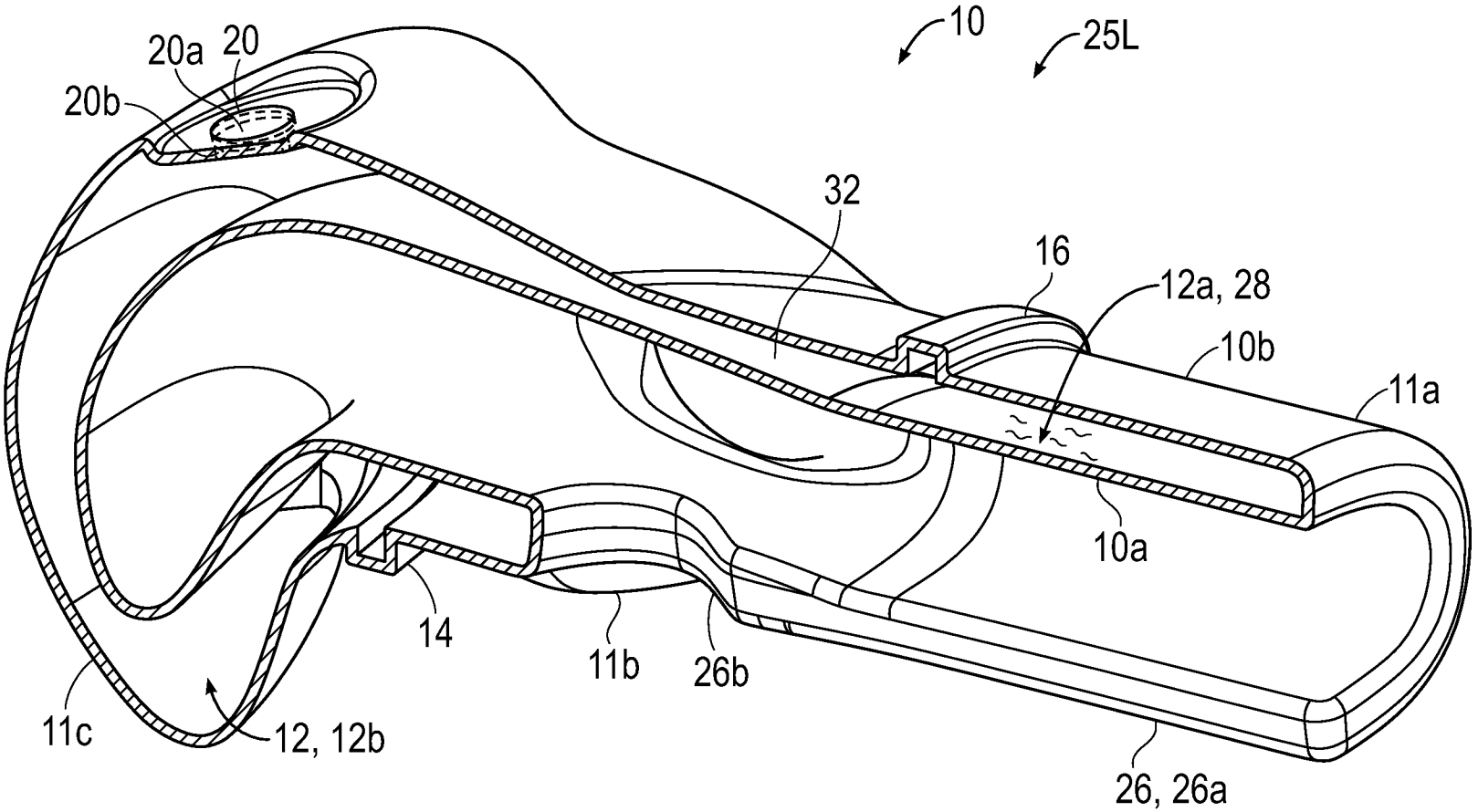
FIG. 11 is a perspective side sectional view of an embodiment of the left glove.

FIGS. 6 and 7 show another embodiment of an exercise device or glove 10 in the present invention which differs from that shown in FIGS. 4 and 5, in that the glove 10 can have a slot 16 with lace holes and laces on the palm side or underside, for tightening the glove on the user's hand. Additionally, or alternatively, a hook and loop or foldover strap 18 can be used for securement. A grip bar 14 can be provided on the front or palm for gripping, and a reinforcing bar 16 can be provided on the back of the wrist portion. A fill valve 20 can be provided at the back of the hand or dorsal portion. An inner fabric or cloth liner 10*a* in the shape of a mitten can be secured to the glove at the wrist or forearm potion, and extend within the glove to provide added comfort to the user. The liner 10*a* can have portions held in place with adhesives. Unlike traditional boxing gloves, the inner fabric liner 10*a* can be pulled or removed from the inside while remaining attached for cleaning, drying or airing out the fabric.

Referring to FIGS. 8-15, in another embodiment of the present invention, two exercise devices or gloves 10 can be right 25R and left 25L gloves of a pair. Each glove 10 such as the left glove 25L can have an inner portion 10*a* and an outer portion 10*b*, which can be inner and outer sleeve, glove or mitten portions. The glove 10 can have a proximal end, wrist or forearm portion 11*a*, a thumb or middle portion 11*b* having a thumb 13, and a distal end, tip or finger portion 11*c*. A sealed flowable material or fluid tight cavity, chamber, conduit or reservoir 12 for containing a quantity of weighted flowable material, fluid or water 28, can extend between the inner 10*a* and outer 10*b* mitten portions from the wrist portion 11*a* to the finger portion 11*c* to provide at least one flowable material or fluid flow conduit, channel or path 32, extending between the wrist 11*a* and finger 11*c* portions. The cavity 12 can include a proximal or wrist portion flowable material or fluid cavity region 12*a* and a distal finger portion flowable material or fluid cavity region 12*b*. The front or palm of the glove 10 can include an elongate opening 26 having a slot portion 26*a* extending from the proximal end of the glove 10, and a rounded notched portion 26*b* in the area of the palm, to allow size adjustment of the wrist portion 11*a* of the glove 10 to fit the user, such as with laces or a hook and loop or fold over strap 18, such as seen in FIG. 6. The back or dorsal side of the glove 10 near or at the finger portion 11*c* can include a fill valve 20, or a recessed or indicated region for installing the fill valve 20. In some embodiments, the fill valve 20 can include a threaded opening 20*b* and a threaded cap 20*a* that secures and seals therein. The threaded opening 20*b* can include a metallic threaded insert molded into the outer mitten portion 10*b*. The glove 10 can include a grip bar 14 on the front or palm, and a reinforcing bar 16 on the back or dorsal side of the wrist portion 11*a*. The inner 10*a* an outer 10*b* mitten portions can be made of the same material, such as 0.1 or 0.125 inch thick rubber, polymeric or plastic material which can in some embodiments be PVC, molded, joined and sealed together at the proximal end of the wrist portion 11*a*. The thumb and distal finger portions of the inner mitten portion 10*a* can be movable within and relative to the outer mitten portion 10*b* by the user's thumb and fingers. In some embodiments, the glove 10 can have a weight ranging from about 2.25 lbs. to about 2.5 lbs. while empty, and can be filled with up to about 58 fluid ounces of water 28 or about 3.75 lbs. of water 28, to provide a total weight of a glove 10 filled with water 28 of about 6 lbs. to about 6.25 lbs.

Figure 15:
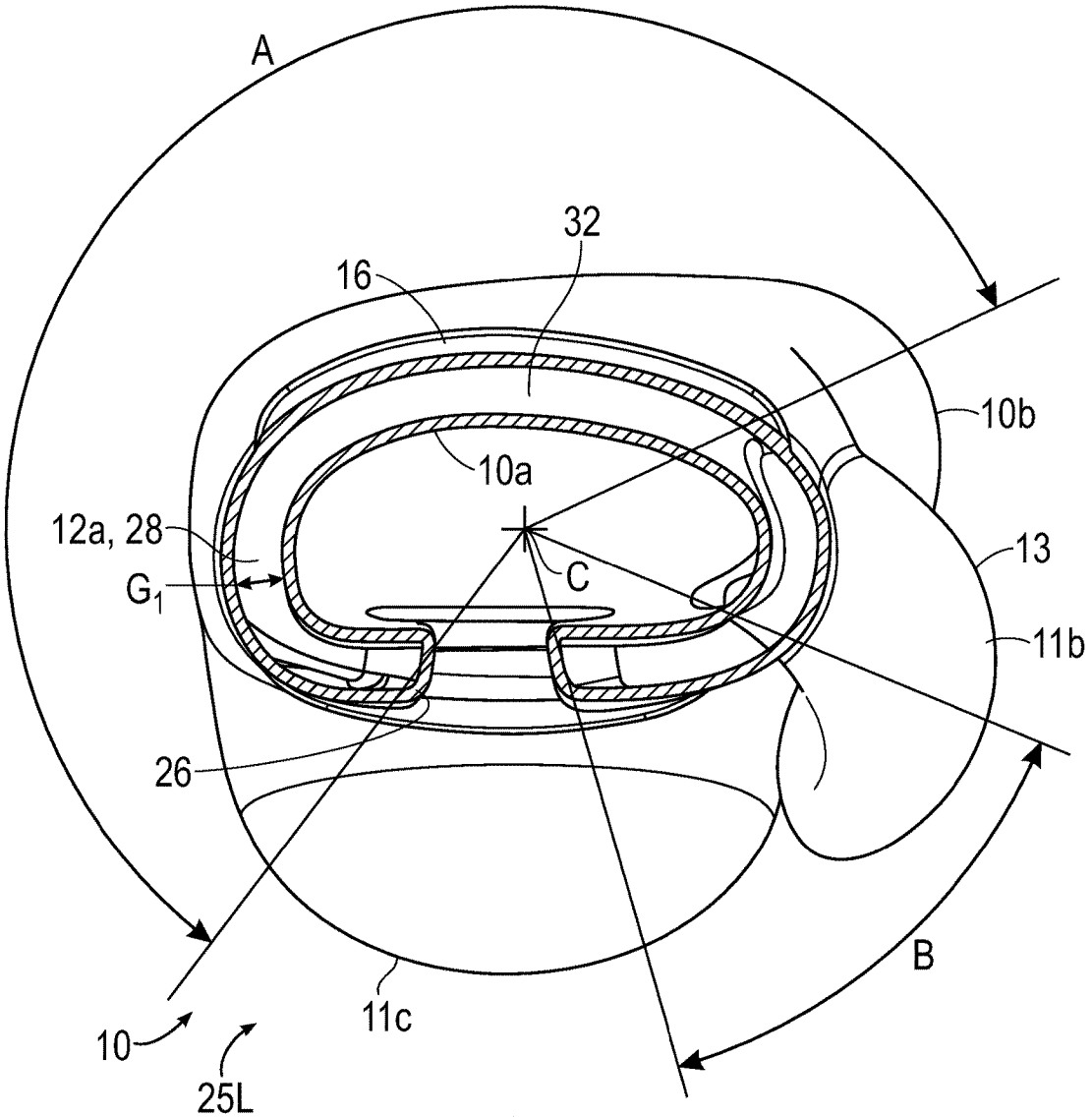
FIG. 15 is a cross-sectional view of the left glove through the wrist portion.
Figure 16:
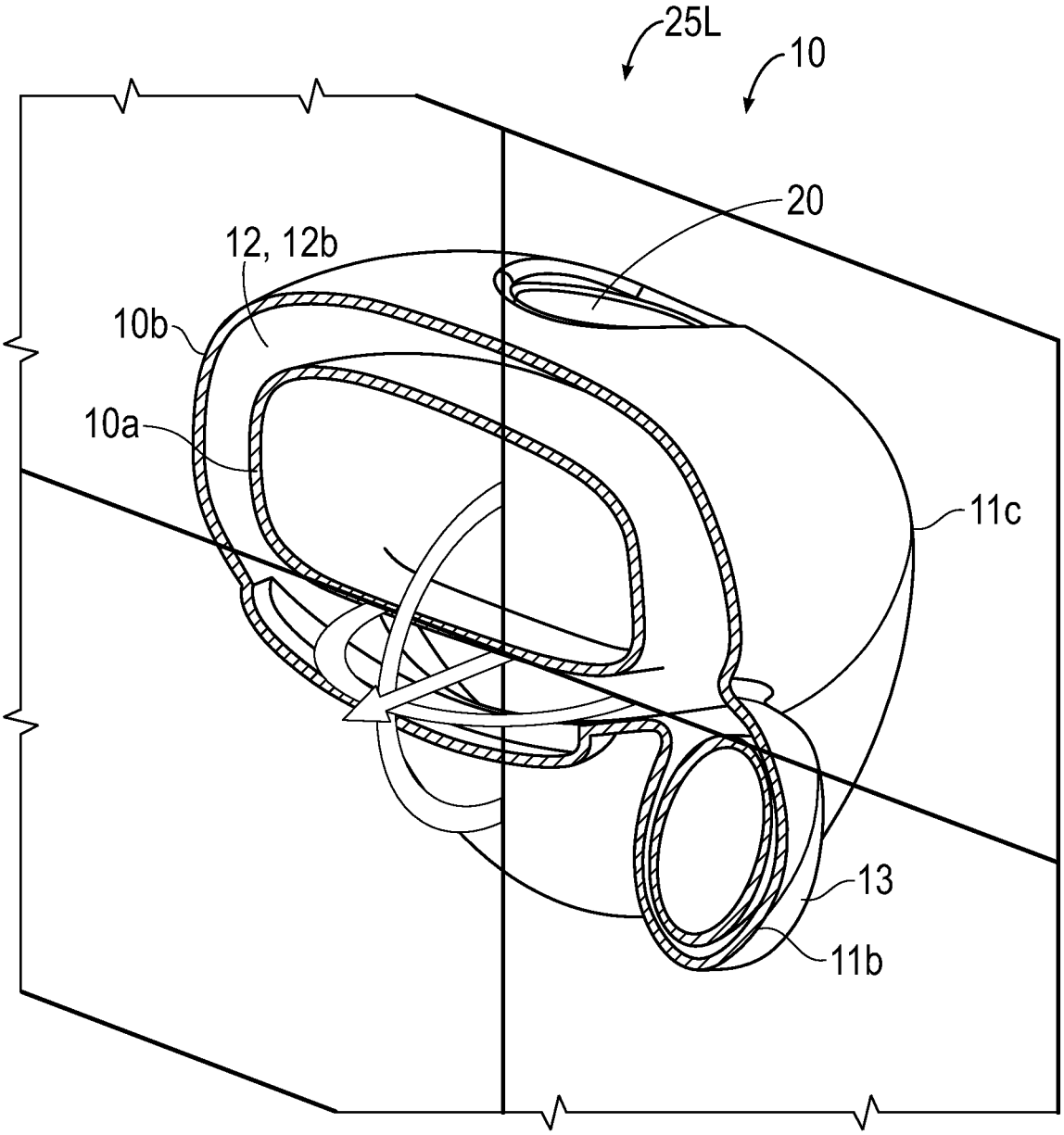
FIGS. 16-18 are perspective cross sectional views through various locations of the left glove near the finger portion and moving rearwardly.
Figure 17:
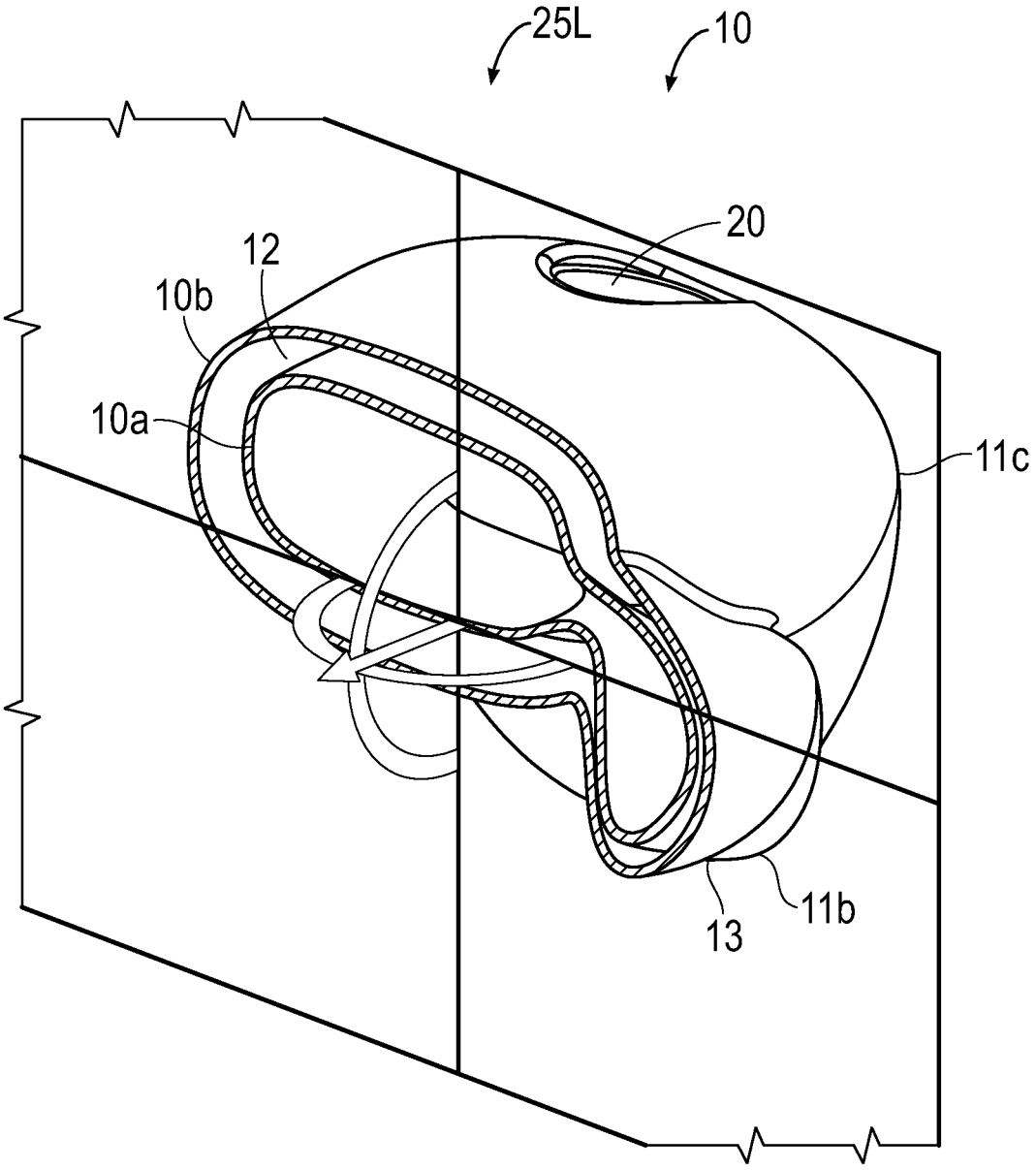
Figure 18:
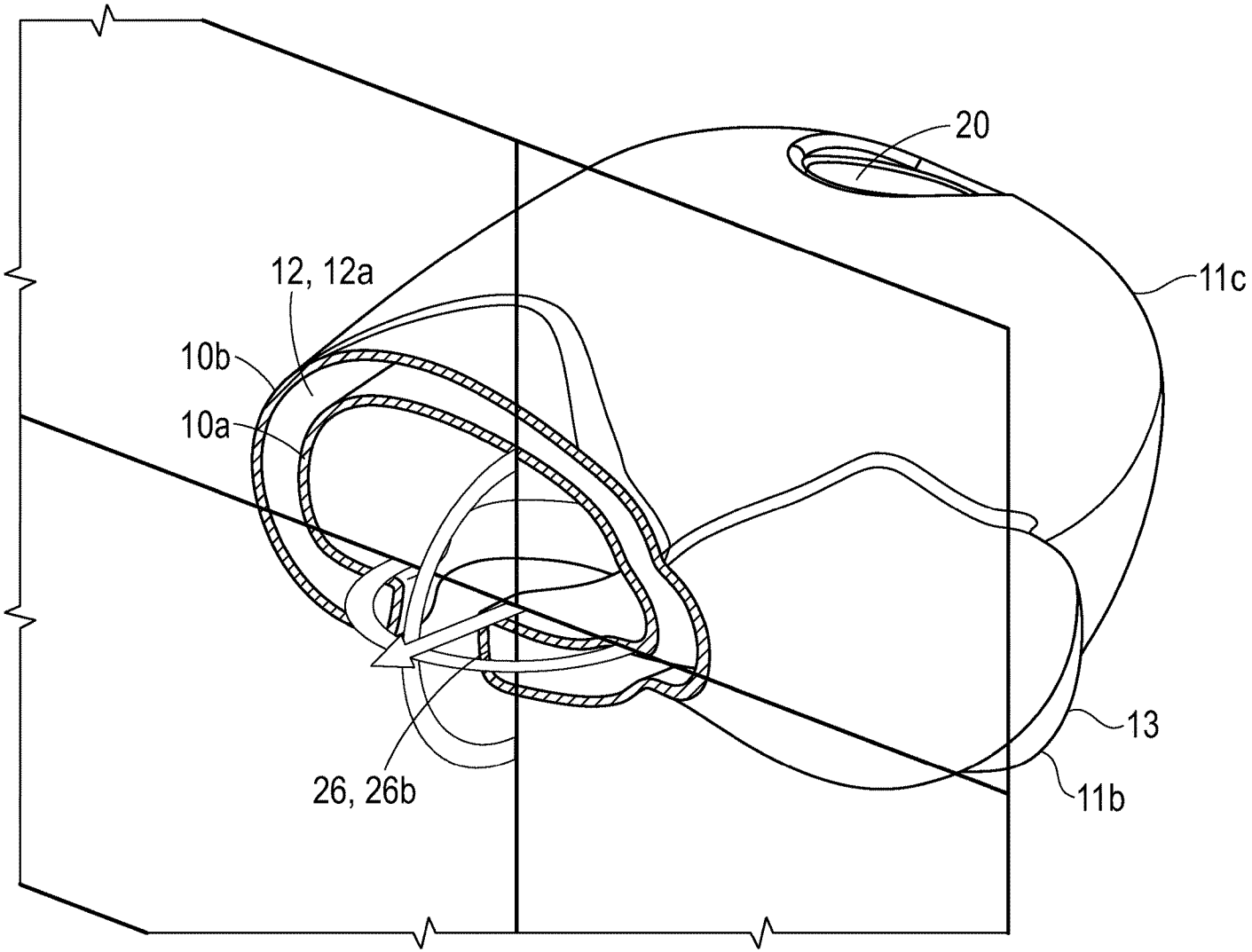

Referring to FIGS. 11-15, the slot portion 26*a* in the palm or front side of the wrist portion 11*a* can form a gap or interruption in the generally oval circumference or perimeter of the wrist portion 11*a* on the front or palm side, such that the wrist portion fluid cavity region 12*a* has a cross section that can be torc shaped or have an interrupted oval ring shape (an oval ring with a small portion missing), forming a majority of the oval ring shape (FIG. 15). In some embodiments, the wrist portion fluid cavity region 12*a* can be generally circular in cross sectional shape with a small segment removed, forming a gap. The finger portion fluid cavity region 12*b* can extend around the generally oval circumference or periphery of the inner mitten portion 10*a* and beyond or around the distal end of the inner mitten portion 10*a*, and joins the wrist portion fluid cavity region 12*a* at the thumb portion 11*b* where the partial generally oval circumferential wrist portion fluid cavity region 12*a* transitions into the full generally oval circumferential finger portion fluid cavity region 12*b* as seen in FIGS. 16-18. Although the thumb 13 can somewhat interrupt the circumference of the fluid cavity 12 on one side forming a second or sequential generally torc shaped cross section (FIG. 17), this can occur after the slot 26, thereby avoiding excessive flow restriction. In addition, the size of the finger portion fluid cavity region 12*b* in this region can expand in size to increase flow path size and flow.

Figure 12:
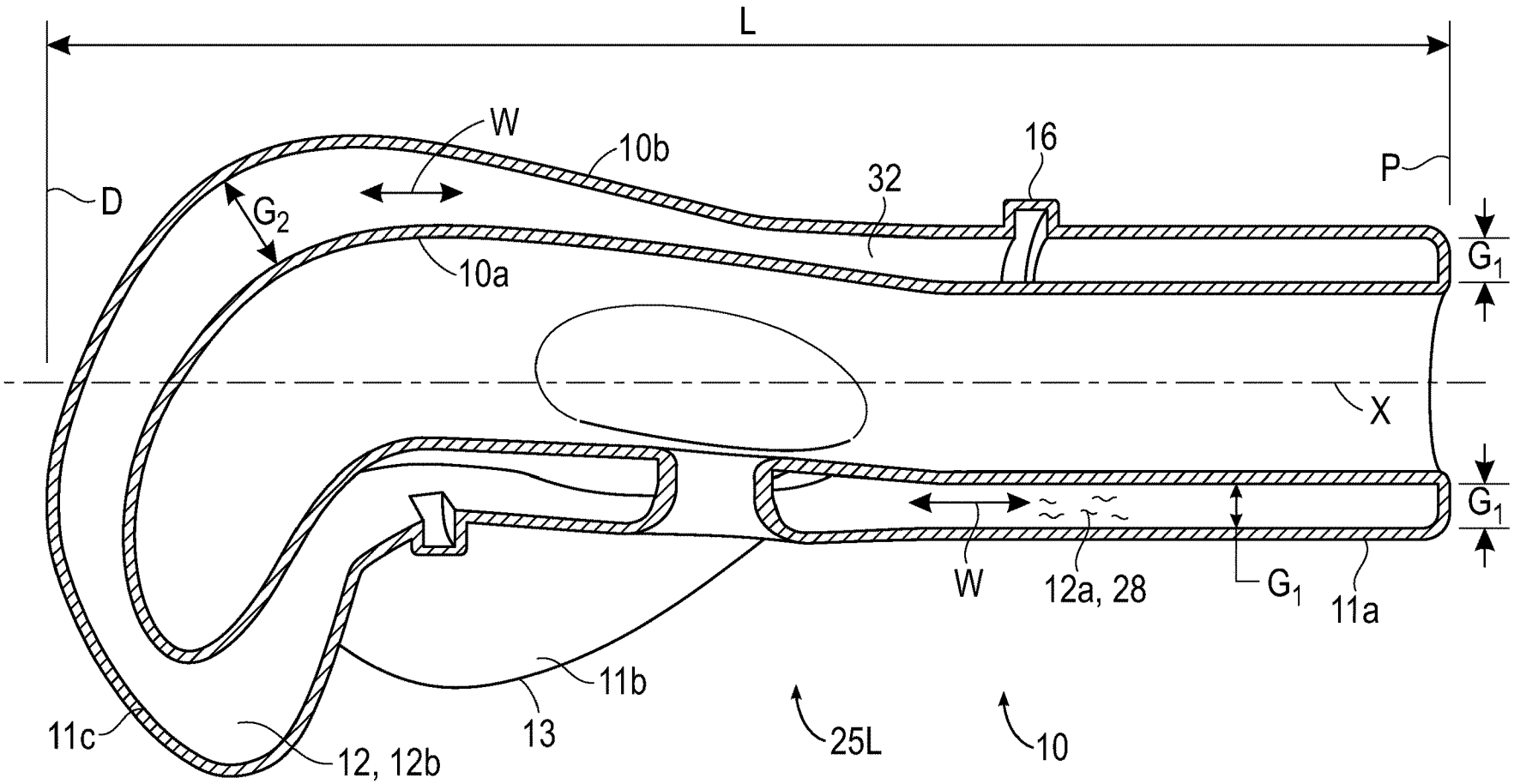
FIG. 12 is a side sectional view of the left glove.
Figure 13:
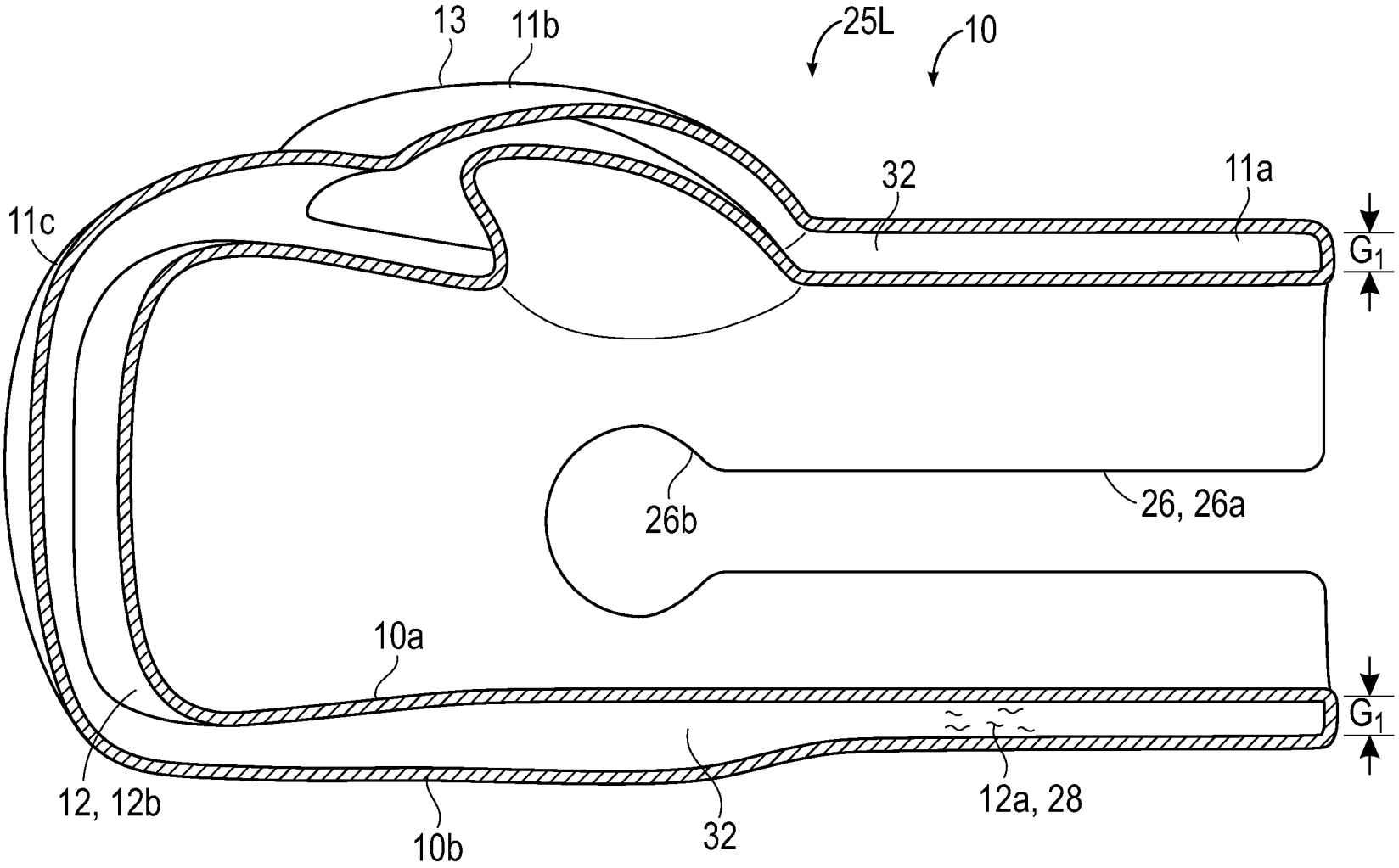
FIG. 13 is a back or dorsal sectional view of the left glove.
Figure 14:
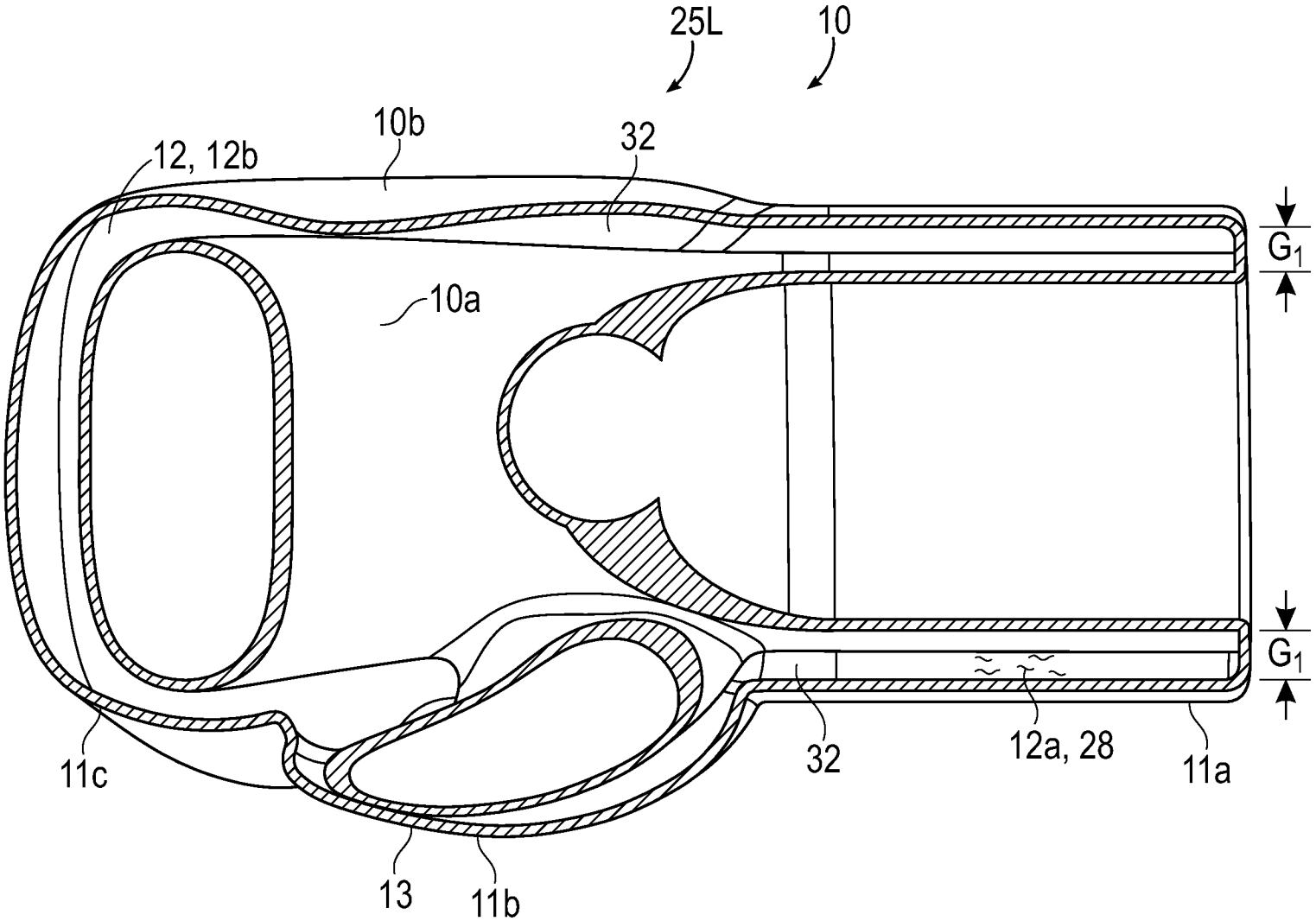
FIG. 14 is a front or palm sectional view of the left glove.

Referring to FIG. 12, when glove 10 is partially filled with flowable material or fluid such as water 28, during reciprocation of glove 10, water 28 within fluid cavity 12 can reciprocate generally longitudinally in the direction of the longitudinal axis X of glove 10, back and forth as indicated by arrows W, between the proximal end P and the distal end D of the fluid cavity 12 at the wrist portion 11*a* and finger portion 11*c*. As seen in FIGS. 12-18, the majority of the generally oval circumference of the fluid cavity 12 provides a generally straight longitudinal fluid flow channel or path 32 from the wrist portion 11*a* to the finger portion 11*c*, with slight gaps, diversions or interruptions at the wrist portion 11*a* by slot 26, and the thumb portion 11*b* by the thumb 13. FIGS. 15-18 show that slot 26 and the thumb 13 separately and sequentially divert, redirect or restrict small amounts of flow, and can reduce the generally oval annular cross section of the fluid cavity 12 only about 1/10-1/12 by the slot 26, and only about 1/19-1/20 by the thumb 13, so that the majority of the fluid cavity 12 has a generally straight longitudinal path between the proximal P and distal D ends along or parallel to the longitudinal axis X. Referring to FIG. 15, the generally flat or horizontal portion on the palm side of the wrist portion fluid cavity region 12*a* on the two opposite sides of the slot 26 has generally straight longitudinal flow paths to the finger portion fluid cavity region 12*b*. The dorsal side of the wrist portion fluid cavity region 12*a* to the dorsal side of the finger portion fluid cavity region 12*b* at the back of the glove 10 and the user's hand can also have a generally straight longitudinal flow path therebetween (FIG. 12). Additionally, the fluid cavity 12 can have a generally straight longitudinal flow path between fluid cavity regions 12*a* and 12*b* at the proximal P and distal ends D in a cross section having a generally oval annular arc shape extending from one side of the slot 26 to the thumb 13 at the thumb portion 11*b*, measured in a circular angular arc length A of about 190 deg-230 deg, and can be about 210 deg. The generally straight longitudinal flow path between the slot 26 and the thumb 13 extending between fluid cavity regions 12*a* and 12*b* can have an oval annular arc shape measured in a circular arc length B of about 50 deg. This can allow the flowable material or water 28 to flow back and forth in a generally straight longitudinal manner with minimal flow restrictions and delays, so that fast reciprocating exercises can be performed with gloves 10.

In some embodiments, the length L of the flowable material or fluid cavity 12 between the proximal end P distal end D can be about 6 or 7-15 inches long, and can often be about 12 to 13 inches long. The wrist portion fluid cavity region 12*a* can have a channel width or gap $G_1$ of about 3/16 or ¼ inch to about ¾ inches, often being about ⅜ inch to about ⅝ inch, and often can be about ½ inch. The finger portion fluid cavity region 12*b* can have a variable channel width or gap $G_2$ in selected regions of about ⅜ or ½ inch to about 2 inches, often being about ¾ inch to about 1½ or 1¾ inches, and often can have variable size zones moving towards the distal end. Since the inner 10*a* and outer 10*b* mitten portions can be made of flexible material, flexing can cause changes in sizes of the gaps $G_1$ and $G_2$ during use. Having an outer glove or mitten 10*b* with an enlarged circumference can provide enlarged gaps $G_1$ and $G_2$ in the wrist 11*a* and finger 11*c* portions which can maximize volume and length of cavity 12 and can allow increased flowable material or fluid containment for increased weight, as well as flow in the direction of arrows W with less flow restriction or resistance, to provide fast flow speed. The sizes can differ depending upon the size of the glove 10 which can be different for different size users, such as children, women and men. In some embodiments, the slot 26 can be omitted so that the wrist portion fluid cavity region 12*a* can be completely circumferential, to increase flowable material or water containment and flow into the wrist portion 11*a*. In some embodiments the wrist portion 11*a* can be circular instead of oval. In some embodiments, the exercise device does not have to have a glove shape or look like a glove.

For some exercises, the fluid cavity 12 of glove 10 can be filled completely or close to full capacity (close to or at about 100%), to exercise with glove(s) 10 as a dead weight, where internal fluid flow inertial forces are absent, mitigated or reduced.

In some embodiments, the exercise device or glove 10 can be used exercise for patients such as stroke and Parkinson patients. Gloves 10 allow patients to exercise with weight without requiring gripping of a handle, making weighted exercise possible to those without hand dexterity or strength.

While example embodiments have been particularly shown and described, it will be understood by those skilled in the art that various changes in form and details may be made therein without departing from the scope of the embodiments encompassed by the appended claims. For example, various features in the different embodiments can be omitted or combined together.

What is claimed is:

1. An exercise glove comprising: an outer mitten portion; and an inner mitten portion nested within the outer mitten portion and extending along a longitudinal axis providing the exercise glove with a wrist portion, a finger portion, and a thumb portion, the inner and outer mitten portions being molded from polymeric material and each having a wall thickness of 0.1 inches or more, the inner mitten portion having an opening at the wrist portion for insertion of a user's hand, the inner and outer mitten portions being attached together at the wrist portion in a fluid sealed manner to form a fluid tight cavity between opposing surfaces of the nested inner and outer mitten portions, the fluid tight cavity extending through the wrist portion, the thumb portion and the finger portion, and capable of being either completely filled with fluid or partially filled with fluid, the inner and outer mitten portions being shaped and sized to provide at least one fluid flow channel extending from the wrist portion to the finger portion between the nested inner and outer mitten portions that is configured to allow the fluid to flow from the wrist portion to the finger portion and back again, when worn by a user conducting reciprocating exercises and the fluid tight cavity is partially filled with fluid, the fluid tight cavity having a circumferential finger portion fluid cavity region between the opposing surfaces of the inner and outer mitten portions with at least a portion that extends around a periphery of the inner mitten portion at the finger portion in a direction that is transverse to the longitudinal axis, the inner and outer mitten portions being shaped and sized to provide the wrist portion with an enlarged gap between the inner and outer mitten portions in the range of ¼ inch to ¾ inches, and to provide the finger portion with an enlarged gap in selected regions between the inner and outer mitten portions in the range of ½ inch to 2 inches, that are aligned with each other to provide the at least one fluid flow channel with a generally straight longitudinal flow path along or parallel to the longitudinal axis between the wrist portion and the finger portion, wherein the enlarged gap in the selected regions of the finger portion is larger than the enlarged gap in the wrist portion.

2. The exercise glove of claim 1 in which the thumb portion and the finger portion of the inner mitten portion can be movable within and relative to the outer mitten portion by the user's thumb and fingers.

3. The exercise glove of claim 2 in which the fluid cavity at the finger portion extends around a distal end of the inner mitten portion.

4. The exercise glove of claim 1 in which the wrist portion has a wrist fluid cavity region for containing water and maximizing the volume and length of the at least one fluid channel.

5. The exercise glove of claim 4 in which the enlarged gap in the wrist portion between the inner and outer mitten portions extends around at least a majority of the inner mitten portion.

6. The exercise glove of claim 3 in which a cross section of the wrist fluid cavity region in the wrist portion has an oval ring shape with a small portion missing.

7. The exercise glove of claim 6 in which the wrist portion has a slot extending along a palm side through the inner and outer mitten portions to allow for size adjustment.

8. An exercise glove comprising: an outer mitten portion; and an inner mitten portion nested within the outer mitten portion and extending along a longitudinal axis providing the exercise glove with a wrist portion, a finger portion, and a thumb portion, the inner and outer mitten portions being molded from polymeric material and each having a wall thickness of 0.1 inches or more, the inner mitten portion having an opening at the wrist portion for insertion of a user's hand, the inner and outer mitten portions being attached together at the wrist portion in a sealed manner to form a sealed cavity between opposing surfaces of the nested inner and outer mitten portions, the sealed cavity extending through the wrist portion, the thumb portion and the finger portion, and capable of being either completely filled with flowable material or partially filled with flowable material, the inner and outer mitten portions being shaped and sized to provide at least one flowable material flow channel extending from the wrist portion to the finger portion between the nested inner and outer mitten portions that is configured to allow the flowable material to flow from the wrist portion to the finger portion and back again, when worn by a user conducting reciprocating exercises and the sealed cavity is partially filled with flowable material, the sealed cavity having a circumferential finger portion cavity region between the opposing surfaces of the inner and outer mitten portions with at least a portion that extends around a periphery of the inner mitten portion at the finger portion in a direction that is transverse to the longitudinal axis, the inner and outer mitten portions being shaped and sized to provide the wrist portion with an enlarged gap between the inner and outer mitten portions in the range of ¼ inch to ¾ inches, and to provide the finger portion with an enlarged gap in selected regions between the inner and outer mitten portions in the range of ½ inch to 2 inches, that are aligned with each other to provide the at least one fluid flow channel with a generally straight longitudinal flow path along or parallel to the longitudinal axis between the wrist portion and the finger portion, wherein the enlarged gap in the selected regions of the finger portion is larger than the enlarged gap in the wrist portion.

9. The exercise glove of claim 8 in which the inner and outer mitten portions are attached together in a fluid sealed manner to form a fluid tight cavity, and the at least one flowable material flow channel forms at least one fluid flow channel when the fluid cavity is at least partially filled with fluid.

* * * * *